US005141243A

United States Patent [19]

Meatto

[11] Patent Number: 5,141,243

[45] Date of Patent: Aug. 25, 1992

[54] ALPINE SKI WITH A SIMPLIFIED CONSTRUCTION

[75] Inventor: Franklin D. Meatto, Carlsbad, Calif.

[73] Assignee: Pacific Coast Composites, Inc., San Marcos, Calif.

[21] Appl. No.: 467,914

[22] Filed: Jan. 22, 1990

[51] Int. Cl.[5] ..... A63C 5/04; A63C 5/048

[52] U.S. Cl. ..... 280/602; 280/608; 280/609; 280/610

[58] Field of Search ..... 280/610, 608, 609, 602, 280/601

[56] References Cited

U.S. PATENT DOCUMENTS

| | | | |
|---|---|---|---|
| 2,277,281 | 3/1942 | Vinton | 280/601 |
| 2,743,113 | 4/1956 | Griggs | 280/11.13 |
| 3,074,732 | 1/1963 | Riha | 280/11.13 |
| 3,083,977 | 4/1963 | Dunston | 280/11.13 |
| 3,762,734 | 10/1973 | Vogel | 280/11.13 |
| 3,918,728 | 11/1975 | Stugger et al. | 280/608 |
| 4,065,150 | 12/1977 | Van Auken | 280/610 |
| 4,140,330 | 2/1979 | Ferch | 280/610 |
| 4,233,098 | 11/1980 | Urbain | 280/610 |
| 4,270,768 | 6/1981 | Nakanishi | 280/610 |
| 4,409,287 | 10/1983 | Harrison | 428/343 |
| 4,537,417 | 8/1985 | Hirnbock et al. | 280/610 |
| 4,705,291 | 11/1987 | Gauer | 280/609 |
| 4,953,884 | 9/1990 | Diard et al. | 280/601 |

FOREIGN PATENT DOCUMENTS

| | | | |
|---|---|---|---|
| 52-6239 | 1/1977 | Japan | 280/610 |
| 85837 | 5/1955 | Norway | 280/609 |

*Primary Examiner*—Andres Kashnikow
*Assistant Examiner*—Eric Culbreth
*Attorney, Agent, or Firm*—Ralph D'Alessandro

[57] ABSTRACT

In an alpine ski there is provided a simplified laminated construction by providing a glass fiber reinforced beam laminated on the tensile facing to a single laminate layer of stiffening material and a bottom running surface. Grooves are machined into the central glass fiber reinforced beam to adjustably control both the ski's weight and stiffness and a continuous metallic sidewall is provided between the bottom edges and the top edges. A decorative cap that conforms to the contour of the top surface of the glass fiber beam is laminated to the beam.

43 Claims, 3 Drawing Sheets

ALPINE SKI WITH A SIMPLIFIED CONSTRUCTION

BACKGROUND OF THE INVENTION

This invention relates generally to a ski structure. More specifically it is directed to a new and improved laminated ski structure that employs a solid synthetic structural beam as the main structural reinforcing member.

The evolution of alpine or downhill skis has moved from a shaped wooden beam that was improved by adding wear surfaces to the bottom and outer edges to a beam formed from either a combination of wood and synthetic plastic layers or entirely of plastic layers. In the interim an aluminum composite beam was employed to enhance performance and durability characteristics. The advancement to plastic laminate layers in ski design included the use of a glass fiber composite "sandwich" beam that was improved by the use of advanced high strength and low weight fibers. Another alternative of the "sandwich" beam structure is the use of a wrapped or torsion box central beam design employing a resin impregnated fiberglass sleeve about the core materials. Attempts to obtain lower cost skis have also provided the foamed Reaction Injection Molded (RIM) ski design.

All of these designs have involved costly materials, or labor intensive manufacturing steps or final products with undesireable performance characteristics. Where weight was reduced, frequently the durability and flexural characteristic of the ski were compromised. Where desired flexural and torsional spring constants were combined with the needed dynamic properties of a high rate of return and vibrational damping, costly advanced fiber materials were required, especially in the pursuit of lighter weight skis. Frequently, the the inherent tradeoffs among performance characteristics resulted in skis that failed to gain consumer acceptance because of poor aesthetic appeal of the final product, poor performance characteristics, or both.

These problems are solved in the design of the present invention by providing a visually innovative alpine ski with advanced performance characteristics that is easily manufactured.

SUMMARY OF THE INVENTION

It is an object of the present invention to obtain the greatest design flexibility in an alpine ski through variation of the ski's stiffness distribution by changing the depth and/or the width of stiffness grooves provided in the top surface of the ski.

It is another object of the present invention to provide in an alpine snow ski a design that reduces the number of components or structural members in the ski.

It is feature of the present invention that the top surface stiffness adjusting grooves extend from the binding area forward toward the shovel and rearward toward the tail.

It is another feature of the present invention that continuous metallic sidewalls extend from the top edges downwardly to the bottom edges and are secured to the solid synthetic structural beam to provide both base and top surface wear protection.

It is a further feature of the present invention that there are hollow channels extending along the underside of the length of the solid synthetic structural beam to control the weight of the ski.

It is still another feature of the present invention that the solid synthetic structural beam employed in the instant alpine ski is machined via routing and grinding in three dimensions to obtain the desired final shape and weight.

It is yet another feature of the present invention that in one embodiment the solid synthetic structural beam is pulformed in the flat and subsequently laminated to a stiffening layer of unidirectional fiberglass and a bottom running surface.

It is still a further feature of the present invention to provide in one embodiment an alpine snow ski that employs a solid synthetic structural beam of pulformed unidirectional fiberglass.

It is an advantage of the present invention that an alpine ski is obtained which has a thinner side profile but still retains the stiffness distribution of a conventional ski.

It is another advantage of the present invention that an alpine ski is obtained which can have very soft flexural characteristics, but exhibit higher strength than traditional alpine skis of equivalent stiffness.

It is still another advantage of the present invention that the solid synthetic structural beam provides sufficient binding retention in the binding mounting area so as not to require any additional reinforcement such as the usual weight increasing binding plate.

It is yet another advantage of the present invention that an alpine ski is produced by a simplified manufacturing process employing significantly fewer steps, a continuous manufacturing process to produce the primary central pulformed beam and an easily adaptable manufacturing method to obtain efficient operation whether at high or low production rates.

It is still another advantage of the present invention that an alpine ski can be produced via an improved manufacturing process in which the sidecut geometry and contact lengths are easily changeable.

It is another advantage of the present invention that an alpine ski is obtained which has top and bottom surface wear edges of greater wear resistance.

It is yet another advantage of the present invention that an alpine ski is obtained that has greater top surface and running surface or base protection at the ski's critical extremities.

These and other objects, features and advantages are obtained in the alpine ski of the present invention, and the process of manufacturing such a ski, by providing a solid synthetic structural beam that is three dimensionally shaped with longitudinal grooves in the top surface and internal grooving in the bottom surface, laminated to a bottom tensile reinforcing layer and a bottom running surface, and joined to sidewalls formed of continuous single pieces of metal. A top cap with decorative graphics is joined to the top surface of the formed and shaped solid synthetic structural beam.

BRIEF DESCRIPTION OF THE DRAWINGS

The advantages of this invention will become apparent upon consideration of the following detailed disclosure of the invention, especially when it is taken in conjunction with the drawings wherein.

DETAILED DESCRIPTION OF THE PREFERRED EMBODIMENT

Figure 1:
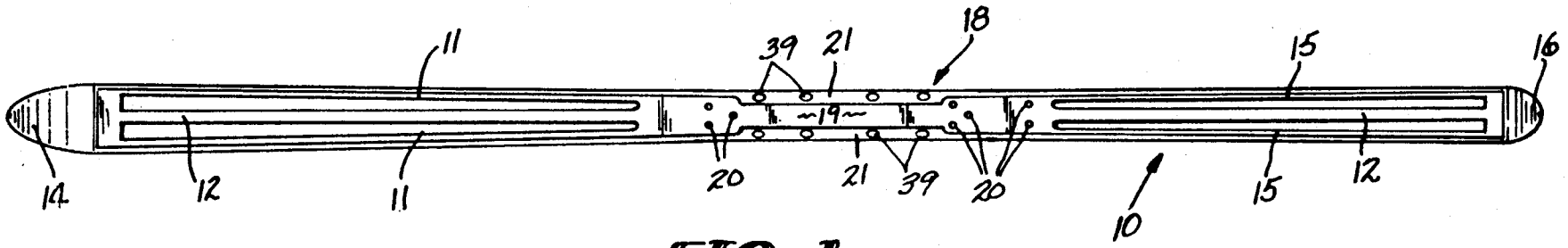
FIG. 1 is a top plan view of a snow ski incorporating the structure of the present invention.

FIG. 1 shows a top plan view of the ski 10 having a pair of grooves 11 in the top surface 12 closest the shovel 14 and a corresponding pair of grooves 15 in the top surface 12 closest the tail 16. A binding mounting area indicated generally by the numeral 18 is located between the shovel 14 and the tail 16 and can consist of a flattened surface area 19, into which the bindings (not shown) are mounted via binding screws placed into, for example, binding screw holes 20, and tapered sides 21 which extend angularly downwardly and outwardly toward the bottom running surface 22 of FIG. 2.

Figure 3:
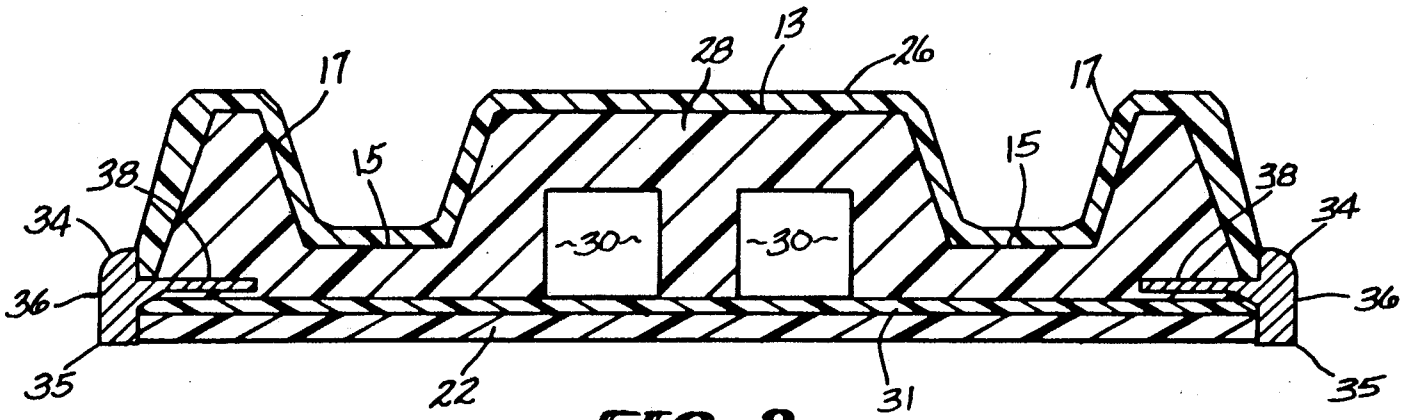
FIG. 3 is a sectional view taken along the lines 3—3 of FIG. 2 showing the improved design of the ski to the rear of the binding area.
Figure 4:
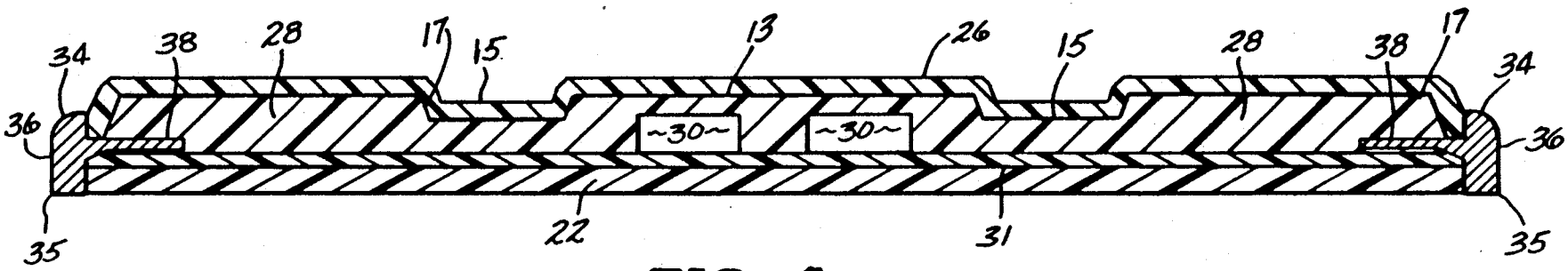
FIG. 4 is a sectional view taken along the lines 4—4 of FIG. 2 showing the cross section adjacent to the tail of the ski.
Figure 5:
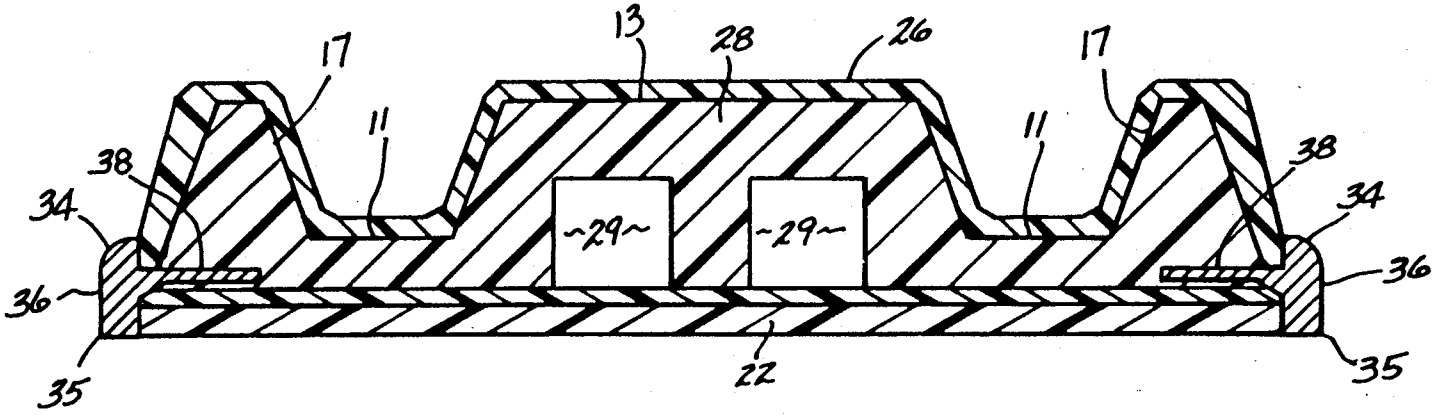
FIG. 5 is a sectional view taken along the lines 5—5 of FIG. 2 showing the improved design of the ski in cross section forward of the binding area.
Figure 6:
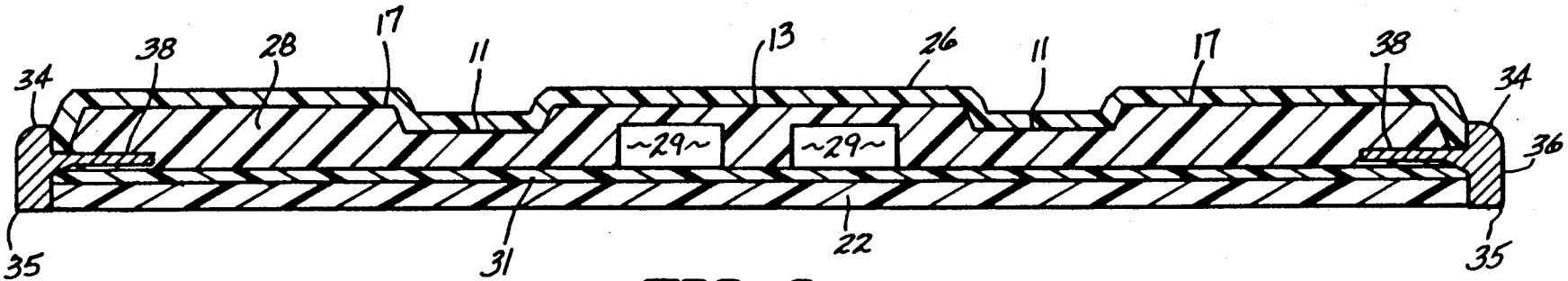
FIG. 6 is a sectional view taken along the lines 6—6 of FIG. 2 showing the cross section adjacent to the shovel of the ski.

Grooves 11 and 15 angle outwardly on their outboard side as they extend from the binding area 18 toward the shovel 14 and the tail 16, respectively. Grooves 11 and 15 also are tapered in depth relative to the top surface as they extend toward the shovel 14 and the tail 16 such that they are deeper nearest the binding area 18 and shallower nearest to the shovel 14 and the tail 16 to provide controllably designable weight and stiffness to the ski 10. FIGS. 3 and 4 show this tapering effect for the tail 16 end and FIGS. 5 and 6 show this for the shovel 14 end.

Figure 2:
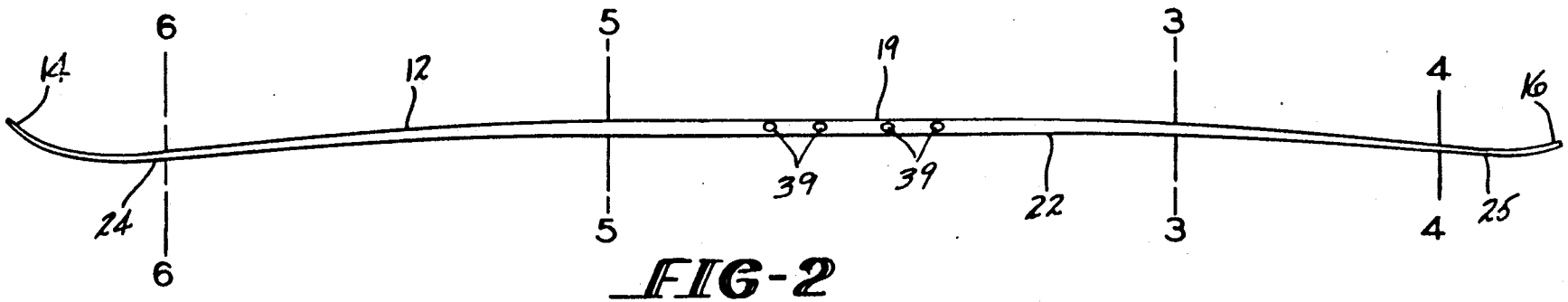
FIG. 2 is a side elevational view of the snow ski.

FIG. 2 also shows the camber of the ski 10 by the curvature of the ski 10 upwardly from the front contact point 24 and downwardly toward the rear contact point 25.

FIGS. 3 and 4 show cross-sectional views of the tail 16 end of the ski 10 taken along the section lines 3—3 and 4—4, respectively. Similar cross-sectional views of the shovel 14 end of the ski 10 taken along the section lines 5—5 and 6—6 are shown in FIGS. 5 and 6, respectively. A protective cap 26 of suitably low temperature abrasion and cut resistant plastic such as polycarbonate-polyethylene terphthalate alloy or a thermoplastic polyester alloy or thermoset urethane either cast or RIM molded, is laminated to the solid central beam 28. Cap 26 conforms to the shape of the beam 28, which will be described in further detail immediately hereafter.

The beam 28 is preferably pulformed from fiber reinforced plastic and then machined and shaped to its desired contour, such as with computer numerical controlled grinding and/or routing apparatus. The solid synthetic structural beam 28 has the tail grooves 15 and the shovel grooves 11 routed out to form a ski 10 with the desired stiffness distribution along the beam, and the desired flexural and torsional spring constants and dynamic properties, such as ski rate of return and vibration. Widening and/or deepening the grooves 11 and 15 results in a ski 10 of less stiffness along its entire length or at selected sections along its length. The desired ski weight is facilitated by the machining of hollow shovel and tail channels 29 and 30, relative to the bottom surface 22, that are deeper nearer the binding area 18 and shallower adjacent the shovel 14 and tail 16, respectively. Beam 28, after the grooves 11 and 15 are machined out, has central portion 13 and two outboard ridges adjacent the sidewalls 36 in both the shovel 14 end and the tail 16 end.

As seen in FIGS. 3 thru 6, there is tensile reinforcing layer 31 that is laminated to and underlies the main beam 28. Layer 31 is formed of unidirectional fiberglass, preferably E-glass. The bottom running surface 22 is formed of an ultrahigh molecular weight polyethylene and is laminated to the tensile reinforcing layer 31.

The top and bottom metal side edges 34 and 35, respectively, are formed from a single continuous piece of metal forming the sidewall 36 of the ski 10, seen in FIGS. 3 thru 6. Sidewall 36 is joined to the solid synthetic structural beam 28 of the ski 10 by flange or tongue 38 that extends into a groove in each side of the solid synthetic structural beam 28 and is secured in place by an appropriate adhesive (not shown). The protective cap 26 fills in the space between the solid synthetic structural beam 28 and the metallic sidewall 36 and is appropriately contoured by grinding or routing, etc. to mate securely with the sidewalls 36 and the beam 28. The continuous metallic sidewalls 36 are preferably formed of titanium, or a titanium alloy, such as a certifiable titanium/aluminum-vanadium alloy composition. Low carbon steel or stainless steel, or any suitable metal or alloy having the appropriate corrosion resistance and strengths could also be employed.

The solid synthetic structural beam 28 can also be formed in the flat by prelaminating a stack of thinner beams with the highest portion being in the middle to achieve the desired stiffness distribution. The stack of thinner beams would be laminated in a press with an appropriate adhesive, such as two component amine-based epoxy resin. The same type of an adhesive is used to laminate together in an appropriate press or presses the beam 28, the tensile reinforcing layer 31, and the bottom running surface 22. The cap 26 is laminated to the remaining structure last with an appropriate polyurethane or cyanoacrylate adhesive (not shown).

Additional multidirectional fiber laminates could be employed to provide off-axis reinforcement, such as torsional reinforcement, between the solid synthetic structural beam 28 and the tensile reinforcing layer 31. Also, additional fibers, such as S-glass, carbon or polyaramid fibers such as that sold under the brand name KEVLAR by E. I. Dupont de Nemours & Co. could be employed in combination with the E-glass fiber reinforced plastic or in place of it. It should also be noted that the binding area 18 can have its sides 21 tapered at the desired angle to control the weight of the overall ski 10 by removing more or less material of the central beam or core 28 as desired. Beam 28 is sufficiently strong that the binding pullout strength is met merely with the beam itself. This obviates the need for the binding plate used in conventional alpine skis and reduces the overall ski weight and manufacuring complexity, plus increases structural integrity.

The ski 10 in its preferred embodiment is constructed by first pulforming the solid synthetic structural beam 28 either in the flat by prelaminating a stack of thinner beams together or by pulforming a single beam. The beam 28 is then contoured by machining in the top profile and the hollow bottom channels 29 and 30. The grooves 11 and 15 are then machined into the top surface of the beam 28. The solid synthetic structural beam 28, the tensile reinforcing layer 31 and the bottom running surface 22 are laminated together in a press with appropriate adhesives, such as two component amine based epoxy, polyurethane or cyanoacrylate adhesives. This combined postformed beam is removed from the press and is shaped by grinding and/or routing to obtain the desired side angle and rough sidecut geometries. The protective cap or top surface layer 26 is then applied to the top surface of the postformed beam. The opposing sides of the postformed beam are then machined out to form the grooves to receive the flange or tongue 38 of the sidewalls 36 and to trim the excess material of the protective cap 36 in the finishing sidecut operation. The sidewalls 36 are then inserted in the sidewall grooves and secured in place by use of the appropriate adhesive from the group previously named. Any finishing grinding operations for the bottom running surface 22 and the metallic sidewalls 36 are then performed. At this point, if the shovel 14 and the tail 16 were not previously molded, they can be attached by conventional methods.

It is to be understood that while construction of the ski 10 has been described primarily in terms of a solid synthetic structural pulformed beam 28 that is a precured solid blank, other construction techniques are possible to obtain the desired composite polygonal cross-section with the stiffness adjusting grooves in the top surface. The controlling criteria of the technique employed require that the beam 28 and the ski 10 possess suitable stiffness and strength, and that it possess suitable ability to stretch or elongate at cold temperatures.

Other possible construction techniques to obtain the desired ski 10 include the use of resin transfer molding (RTM), compression molding, fiber reinforced thermoplastic injection molding, reinforced reaction injection molding (RRIM) or use of a pultruded structural beam 28. RTM employs a preformed fiberglass mass that is assembled outside of a mold, similiar in shape to the final ski shape, and is then placed in the ski mold. Resin is then injected from one end of the mold, while a vacuum is introduced from the other end to draw the resin through the fiberglass mass. The thus formed structure is then cured in the mold, removed, machined and assembled to its finished form. In compression molding, the fibers, either preformed or in strands, are put in resin in the mold and the mold is closed. The structure is then cured with heat and pressure, and removed. In this approach the blank is either molded into its desired final shape or is machined into its desired final shape after removal from the mold. Reinforced reaction injection molding requires the use of high strength fibers as the reinforcing medium that possess a sufficiently high modulus of elasticity, as well as possessing the aforementioned desired cold temperature characteristics of suitable stiffness and elongation capability. A pultruded beam construction technique employs the pulling of appropriate glass fibers through a resin impregnation tank or bath and then guiding the fibers into and drawing them through a heated die that is either tapered or straight.

The protective cap 26 can also be made by one of several techniques, such as thermoforming a thermoplastic material, injection molding or reaction injection molding suitable urethanes. The plastics employed must possess the previously mentioned low temperature abrasion and cut resistance. The thermoplastic resins used in both of the thermoforming and injection molding techniques must, in addition, possess the characteristic of being formable about a defined shape, such as, for example, a mandrel or be formable into a defined shape, such as, for example, with a mold. The preferred technique for forming the cap 26 is thermoforming.

In this technique the thermoplastic, such as a thermoplastic polyester sold under the tradename of VANDAR by Hoechst Celanese, is thermoformed within a temperature range of about 200° F. to about 1000° F. As the plastic becomes pliable it is removed from the heat source, such as an oven, and drawn down about a mandrel by a vacuum. The plastic cap 26 is allowed to cool on the mandrel. A cooling fan may be employed for this purpose. Once the plastic is hardened, the vacuum is released and the plastic cap 26 is removed from the mandrel and is trimmed or machined to its final shape. It is then laminated to the ski 10 structure by use of the appropriate adhesives, as described above.

Alternately, the cap 26 could be pressure formed with a top matching mold to push the plastic down into the grooves 11 and 15 in the top surface of the synthetic structural beam 28. The cap 26 can also have decorative printing applied to it, preferably by sublimation printing, distortion compensated while it is in the flat for those areas that will be deformed to follow the contour of the grooves 11 and 15 and the opposing sides of the top surface of the beam 28. The cap blank is then subsequently deformed during thermoforming or pressure forming processing.

The considerable list of suitable thermoplastics for use in the cap 26 include but should not be limited to acrylonitrile butadiene styrene (ABS), acetal resins such as polyoxymethylene or polyformaldehyde sold under the tradenames of DELRIN and by E. I. Dupont de Nemours and Company and CELCON by Hoechst Celanese, acrylic alloys, ionomers such as those sold under the SURLYN tradename by Dupont, polyamide-nylons either singly or alloyed with other plastics, polybutylene or alloys thereof, polycarbonate or alloys thereof, polybutylene terephthalate polyesters, polyethylene terephthalate polyesters, polyether, polyether etherketone, polyether sulfone, polyarylether, polyethylene, polyacrylonitrile, polycarbonate polyethylene terephthalate polyimide, polyolefins, polyphenylene ether, polyphenylene sulfide, polypropylene, polysulfone, polyurethane, styrene acrylonitrile copolymers such as those sold under the tradenames of ROVEL by Uniroyal Chemical Company and Lustran by Monsanto Corporation, or thermoplastic elastomer materials.

While the preferred structure in which the principles of the present invention have been incorporated is shown and described above it is to be understood that the invention is not to be limited to the particular details thus presented but, in the practice of the broader aspects of this present invention. For example, the shovel hollow channels 29 and the tail hollow channels 30 would be joined through the binding area 18 to create two continuous hollow channels running from the shovel 14 to the tail 16. Additional grooves could be machined in the central beam 28 in the binding area 18 below where the shovel grooves 11 and tail grooves 15 end. Additionally a plurality of holes 39 could be machined into the opposing sides of the ski above the metallic sidewalls 36 extending partially or entirely thru the cross section of the ski in the binding area 18 to designably control the weight of the ski 10. The scope of the appended claims is intended to encompass all obvious changes in the details, materials and arrangements of parts that will occur to one of ordinary skill in the art upon a reading of this disclosure.

Having thus described the invention, what is claimed is:

1. A snow ski having a shovel and a tail with a binding area therebetween defining the ski length and having two opposing sides and a bottom running surface, the improvement comprising in combination:

(A) a central beam having a top surface and an opposing bottom surface and two opposing side surfaces; and (B) sidewalls attached to the two opposing side surfaces each being formed from a single material and extending continuously between the bottom surface and a location adjacent but below the top surface thereby defining both a top wear edge and a bottom wear edge on each opposing side surface, each sidewall containing the top wear edge and bottom wear edge and extending outwardly of a corresponding opposing side surface; and (C) a protective top cap attached to the top surface of the central beam and being interior of the sidewalls overlying and extending continuously across the top surface and the side surfaces of the central beam.

2. The ski according to claim 1 wherein the sidewalls are formed of metal.

3. The ski according to claim 2 wherein the sidewalls are formed of titanium.

4. The ski according to claim 3 wherein the central beam has a groove machined into each of the two opposing side to receive the sidewalls.

5. The ski according to claim 4 wherein the sidewalls each have a tongue that extends into the groove on each of the two opposing sides.

6. The ski according to claim 5 wherein the central beams is pulformed from material comprising fiber reinforced plastic.

7. The ski according to claim 6 wherein the central pulformed beam is machined to produce a side profile.

8. The ski according to claim 7 further comprising a tensile reinforcing layer intermediate the bottom running surface and the central pulformed beam fastened to the opposing bottom surface.

9. The ski according to claim 8 wherein the central pulformed beam is machined to produce a sidecut geometry.

10. The ski according to claim 9 further comprising a plurality of holes in the protective top cap.

11. The ski according to claim 10 wherein the the plurality of holes extend completely through the ski.

12. The ski according to claim 1 further comprising the beam having at least one groove in the top surface extending from the binding area forward toward the shovel and rearward toward the tail, the at least one groove helping to determine the stiffness distribution along the ski, the ski weight, the flexural and torsional spring constants of the ski and the dynamic properties of the ski.

13. The ski according to claim 12 wherein the at least one groove decreases in depth in the top surface of the central pulformed beam as the groove extends from the binding area toward the shovel and from the binding area toward the tail.

14. The ski according to claim 13 wherein the central pulformed beam has at least one hollow channel in the opposing bottom surface.

15. The ski according to claim 14 further comprising the at one least channel extending substantially the entire length of the ski between the shovel and the tail.

16. The ski according to claim 15 wherein there are at least two grooves in the top surface defining a central portion and two outboard ridges adjacent the opposing sides of the ski.

17. The ski according to claim 16 wherein there are at least two channels in the opposing bottom surface of the pulformed central portion.

18. The ski according to claim 17 wherein the at least two channels are interior of the at least two grooves in the top surface.

19. The ski according to claim 18 wherein the at least two channels decrease in depth as they approach the shovel and tail.

20. A snow ski having a shovel and a tail with a binding area therebetween defining the ski length and having two opposing sides, comprising in combination:

(A) a synthetic structural beam of fiber reinforced plastic having a top surface and an opposing bottom surface and two opposing side surfaces, the beam having at least one groove in the top surface extending from the binding area forward toward the shovel and rearward toward the tail, the at least one groove controlling the stiffness distribution along the beam, the flexural and torsional spring constants of the ski and the dynamic properties of the ski including the rate of return and vibration, the beam further having at least one hollow channel in the opposing bottom surface to control the weight of the ski, the beam further being contoured to its shape by grinding;

(B) a bottom running surface fastened to the beam;

(C) a thermoformed ski top surface conforming in shape to the top surface of the structural beam overlying and extending continuously across the top surface and the two opposing side surfaces of the structural beam and fastened thereto; and (D) sidewalls attached to the two opposing side surfaces of the structural beam and being exterior of the two opposing side surfaces extending continuously between the bottom running surface and a location adjacent but below the top surface of the structural beam thereby defining both a top wear edge and a bottom wear edge on each opposing side surface, each sidewall containing the top wear edge and the bottom wear edge and extending outwardly of each opposing side surface, the ski top surface being interior of the sidewalls.

21. The ski according to claim 20 wherein the thermoformed ski top surface further has decorative printing therein.

22. The ski according to claim 20 further comprising a tensile reinforcing layer intermediate the bottom running surface and the synthetic structural beam fastened to the opposing bottom surface.

23. The ski according to claim 20 wherein the at least one groove decreases in depth in the top surface of the synthetic structural beam as the groove extends from the binding area toward the shovel and from the binding area toward the tail.

24. The ski according to claim 20 wherein the synthetic structural beam has at least one hollow channel in the opposing bottom surface.

25. The ski according to claim 24 further comprising the at least one channel extending substantially the entire length of the ski between the shovel and the tail.

26. The ski according to claim 25 wherein there are at least two grooves in the top surface defining a central portion and two outboard ridges.

27. The ski according to claim 26 wherein there are at least two channels in the opposing bottom surface of the synthetic structural beam.

28. The ski according to claim 27 wherein the at least two channels are interior of the at least two grooves in the top surface.

29. The ski according to claim 28 wherein the at least two channels decrease in depth as they approach the shovel and tail.

30. The ski according to claim 20 wherein the sidewalls are formed of metal.

31. The ski according to claim 30 wherein the sidewalls are formed of titanium.

32. The ski according to claim 30 wherein the synthetic structural beam is machined to produce a desired sidecut and side profile.

33. The ski according to claim 30 wherein the synthetic structural beam has a machined groove in each of the two opposing side surfaces to receive the sidewalls.

34. The ski according to claim 33 wherein the sidewalls each have a tongue that extends into the groove on each of the two opposing side surfaces.

35. The ski according to claim 34 further comprising a plurality of holes in the two opposing surfaces and the top surface layer.

36. The ski according to claim 30 wherein the synthetic structural beam further comprises a central pulformed beam.

37. The ski according to claim 30 wherein the synthetic structural beam further comprises one selected from the group consisting of a resin transfer molded central beam, a compression molded central beam, a fiber reinforced thermoplastic injection molded central beam, a pultruded central beam or a reinforced reaction injection molded central beam.

38. A snow ski having a shovel and a tail with a binding area therebetween defining the ski length and having two opposing sides, comprising in combination:

(A) a synthethic structural beam of fiber reinforced plastic having a top surface and an opposing bottom surface and two opposing side surfaces, the beam having at least one groove in the top surface extending from the binding area forward toward the shovel and rearward toward the tail, the at least one groove affecting the stiffness distribution along the ski, the ski weight, the flexural and torsional spring constants of the ski and the dynamic properties of the ski;

(B) the opposing bottom surface of the synthetic structural beam having at least one hollow channel in the opposing bottom surface extending substantially the entire length of the ski between the shovel and the tail and decreasing in depth as the channel approaches the both the shovel and the tail;

(C) the opposing side surfaces of the ski having metal sidewalls with a top wear edge and a bottom wear edge;

(D) a bottom running surface fastened to the beam; and (E) a thermoformed ski top surface conforming in shape to the top surface of the structural beam and fastened thereto, the thermoformed ski top surface and the opposing side surfaces having a plurality of holes therein.

39. The ski according to claim 38 wherein there are at least two grooves in the top surface of the beam and the thermoformed ski top surface defining a central portion and two outboard ridges adjacent the opposing sides of the ski.

40. The ski according to claim 39 wherein there are at least two channels in the opposing bottom surface of the synthetic structural beam.

41. The ski according to claim 40 wherein the at least two channels are interior of the at least two grooves in the top surface.

42. The ski according to claim 38 wherein the synthetic structural beam has a machined sidecut and side profile.

43. The ski according to claim 38 wherein the synthetic structural beam has a machined groove in each of the two opposing side surfaces to receive the sidewalls.

* * * * *